US005928673A

United States Patent [19]

Ryan et al.

[11] Patent Number: 5,928,673

[45] Date of Patent: Jul. 27, 1999

[54] APPARATUS FOR MOLDING SHOE INSERT

[76] Inventors: Daniel M. Ryan, 5010 Thorncroft Ave., Royal Oak, Mich. 48073; Eric Rzeppa, 39712 Crystal, Sterling Heights, Mich. 48310

[21] Appl. No.: 08/816,862

[22] Filed: Mar. 13, 1997

Related U.S. Application Data

[60] Provisional application No. 60/013,425, Mar. 14, 1996.

[51] Int. Cl.[6] ..... B29D 31/50

[52] U.S. Cl. ..... 425/2; 264/223; 264/DIG. 30

[58] Field of Search ..... 425/2; 264/223, 264/DIG. 30; 12/38, 146 M; 36/88, 154

[56] References Cited

U.S. PATENT DOCUMENTS

| | | | |
|---|---|---|---|
| 1,044,170 | 11/1912 | Guilford | 425/2 |
| 1,682,579 | 8/1928 | Oliver | 36/154 |
| 1,981,941 | 11/1934 | Baxter | 425/2 |
| 2,120,987 | 6/1938 | Murray | 425/2 |
| 2,330,978 | 10/1943 | Klein | 12/146 M |
| 2,487,965 | 11/1949 | Dresser | 264/DIG. 30 |
| 2,887,727 | 5/1959 | Murray | 264/DIG. 30 |
| 2,891,285 | 6/1959 | Kaplan | 425/2 |
| 3,165,782 | 1/1965 | Gardner | 425/2 |
| 3,458,898 | 8/1969 | Casparis | 425/2 |
| 3,782,390 | 1/1974 | Johnson | 264/222 |
| 3,805,773 | 4/1974 | Sichau | 602/28 |
| 3,905,376 | 9/1975 | Johnson et al. | 264/222 |
| 4,139,337 | 2/1979 | David et al. | 425/2 |
| 4,522,777 | 6/1985 | Peterson | 264/223 |
| 4,747,989 | 5/1988 | Peterson | 264/223 |
| 4,888,841 | 12/1989 | Cumberland | 12/38 |
| 5,112,296 | 5/1992 | Beard et al. | 602/28 |

*Primary Examiner*—Robert Davis
*Attorney, Agent, or Firm*—Gifford, Krass, Groh, Sprinkle, Anderson & Citkowski, P.C.

[57] ABSTRACT

An apparatus for neutralizing the leg of a person during the molding of an orthotic is disclosed. The apparatus includes a base, a movable standard supporting a knee caliper and ankle caliper. The knee caliper and ankle caliper have arms movable by a crank to center the knee and ankle on a plane extending through the orthotic. The calipers have height adjustments.

9 Claims, 2 Drawing Sheets

10
12
14
16
18
20
22
24
26
28
30
34
36
38
40
42
44
46
47
48
49
59
62
62
"a"
"p"
"L"
2
2

APPARATUS FOR MOLDING SHOE INSERT

This application claims the benefit of U. S. Provisional Application No. 60/013,425, filed Mar. 14, 1996.

FIELD OF THE INVENTION

I. Background of the Invention

The present invention relates to an apparatus and method of neutralizing a foot during the forming of a custom molded foot orthotic. More particularly, a device having a knee stabilizer and ankle stabilizer.

II. Description of the Prior Art

Devices for molding custom shoe inserts for orthotics have been developed for use with custom molded orthotics, such as the Biothotic System marketed by Orthofeet, Inc. of Hillsdale, N.J. The insole contains a resin and is injected with water to cause a chemical reaction creating a foam which expands and molds to the sole of the foot which is placed on the insole. However, if the foot is not in proper neutral alignment, the molded insole will continue to hold the foot in an improper position. The Biothotic System utilizes wedges which are placed under the orthotic to realign the foot in a neutral position.

The apparatus such as disclosed in U.S. Pat. No. 4,747, 989 to Peterson discloses an apparatus producing a corrected mold for a foot. The apparatus includes a base having a hand stand with a pair of adjustable knee supports. The Peterson system utilizes two pillows under the foot during the molding process. The foreportion of the foot rests on a small cushion during molding and the heel portion rests on a soft built up pillow. The Peterson System positions the forefoot and knee during the molding process, but does not align the ankle. None of the prior art systems properly aligns the leg and foot in a neutral position, that is, with the center of the knee aligned above the center of the ankle with the foot permitted to assume a natural position with the leg in this alignment.

The prior art apparatuses for the molding of custom inserts do not permit the foot to properly assume a neutral position. Accordingly, it would be desirable to have a support device for a leg which permits the foot to be maintained in a neutral position while molding the custom insole.

SUMMARY OF THE INVENTION

A method and apparatus for neutralizing the a foot during the molding of an orthotic is disclosed. The apparatus includes a knee caliper and an ankle caliper supported by a standard extending from a base. The moldable orthotics are positioned in holders formed in the base. The knee caliper and ankle caliper have arms movable to center the knee and ankle on a vertical plane which extends through the center of the orthotic. A crank and screw mechanism is provided to move the arms of each of the calipers an equal distance from the vertical plane to center the leg. The apparatus also includes means for adjusting the height of the knee caliper and the ankle caliper.

The method includes placing a moldable orthotic under the foot of a seated person, positioning a knee caliper beneath the knee of the leg, centering the knee on a vertical plane extending through the orthotic, centering the ankle bone on the vertical plane, and molding a resilient cushion orthotic with the leg held on the vertical plane.

The present invention as well as further objects and advantages thereof will be more fully understood from the following description of the preferred embodiment when read with reference to the accompanying drawings.

DESCRIPTION OF THE PREFERRED EMBODIMENTS OF THE INVENTION

Figure 1:
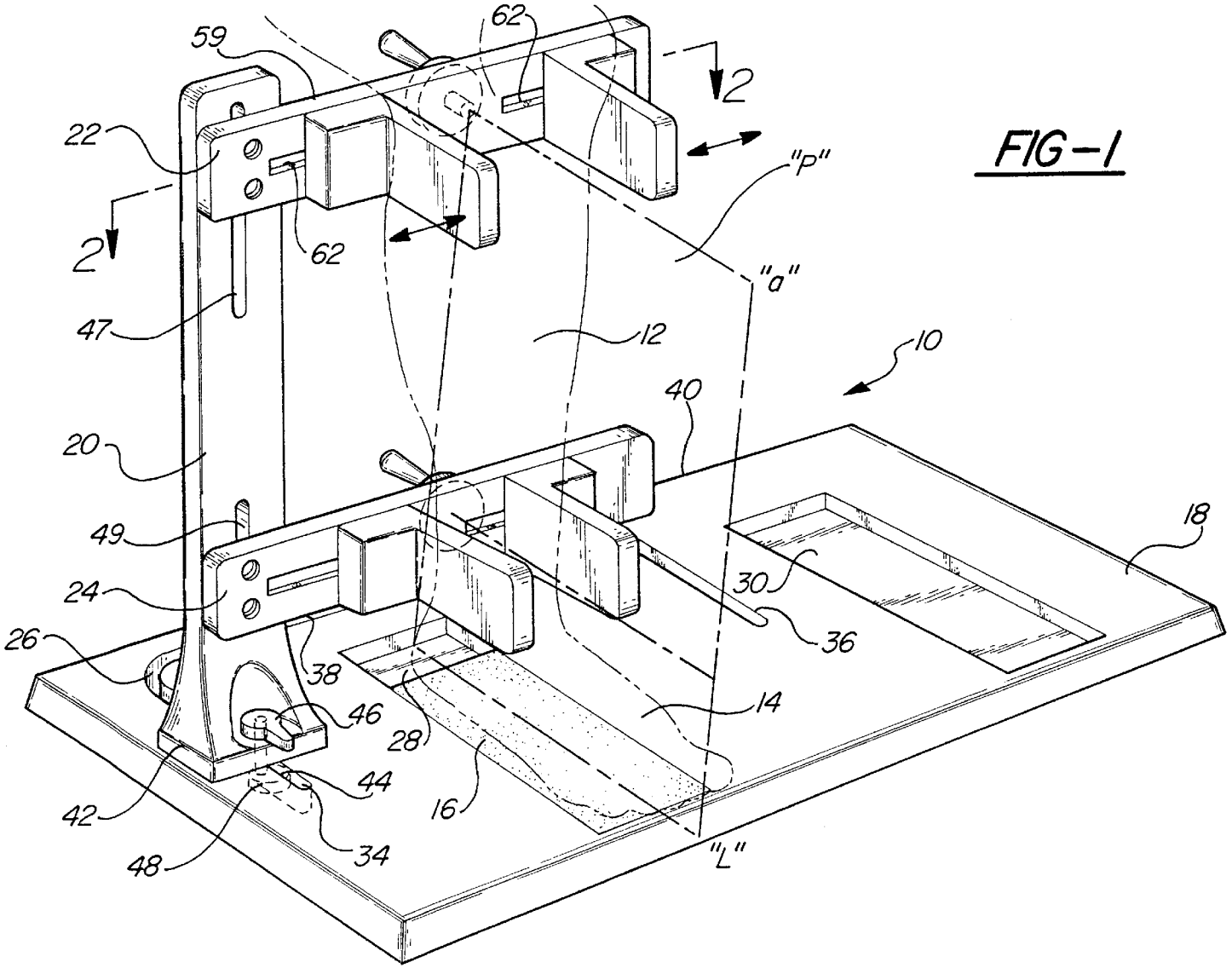
FIG. 1 is a perspective view of the apparatus according to the invention.
Figure 2:
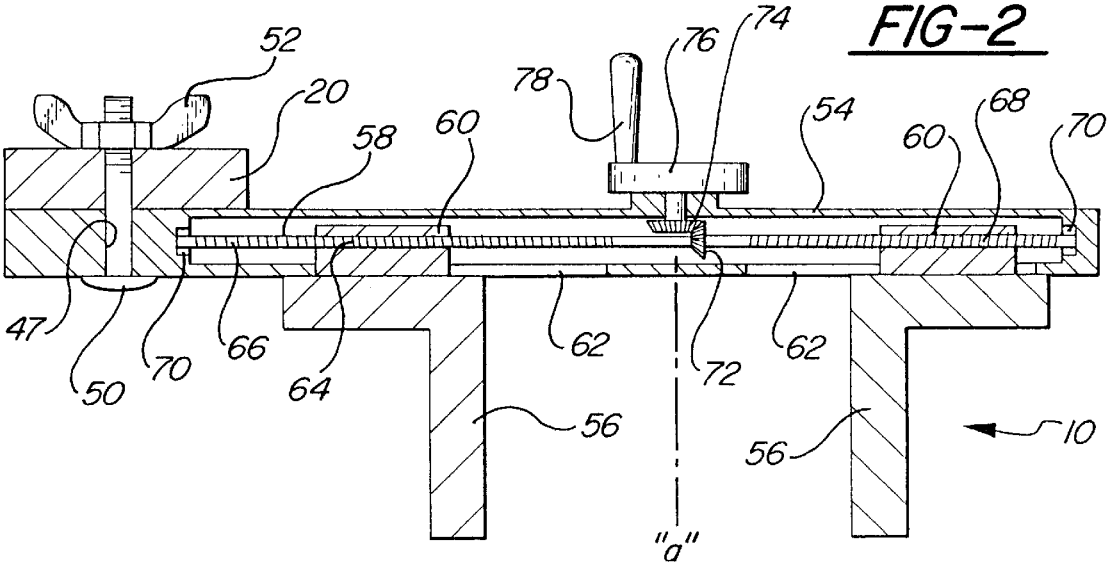
FIG. 2 is a cross-sectional view of a knee caliper taken along lines 2—2 of FIG. 1.

Shown in FIGS. 1 and 2, is a preferred embodiment of an apparatus 10 for neutralizing the leg 12 and foot 14 during the molding of an orthotic 16. The apparatus includes a base 18 supporting a standard 20 having a knee caliper 22 and ankle caliper 24. The base 18 includes a U-shaped channel 26 for positioning the standard 20 with respect to a pair of holders 28, 30 for the moldable orthotic 16. The holders 28, 30 are in the form of recesses formed in the base 18. A suitable orthotic is manufactured by Orthofeet, Inc. of Hillsdale, N.J. The orthotic has a resin which is activated by the injection of water into the orthotic which expands to form a custom mold. The channel 26 has two arms 34, 36 which are spaced equidistant from a central longitudinal axis "L" of the respective orthotic holders 28, 30. A connecting portion 38 extends between the arms 34, 36 adjacent a rear portion 40 of the base 18 to permit positioning of the standard with respect to each of the holders 28, 30.

The standard has a lower portion 42 having a locking mechanism and an upper portion having two slots 47, 49. The locking mechanism includes a threaded pin 44 received in a lever 46. The pin 44 is positioned in an inverted T-shape extending from the lever 46 down into the channel 26. The lever 46 of the locking mechanism is movable from side to side to draw a head 48 of the pin upwardly against the base to lock the standard 20 in position. When the lever 46 is rotated in the opposite direction, the pin 44 is moved downwardly to release the standard 20 and to permit it to slide along the channel 26. The standard 20 may be formed of moldable rigid material such as resin.

As shown in FIG. 2, the knee caliper 22 is slidably mounted to the standard b bolts 50 and wing nuts 52. The wing nuts 52 are used to loosen the bolts to permit the caliper to be slid upwardly and downwardly within the slot 47 to position the caliper at the proper height, as is discussed more fully below.

As best seen in FIGS. 1 and 2, the knee caliper 22 includes a cross piece 54 and a pair of arms 56 which are moved towards and away from a horizontal axis "a" by a screw rod 58. The cross piece 54 has a top surface 59 and a pair of slots 62. Each arm 56 has a slide bar 60 which is received in one of the slots 62. Each slide bar 60 has a threaded bore 64 to receive one of the two oppositely threaded portions 66, 68 of the screw rod 58. The ends of the screw rod 58 are supported by bearings 70. A bevel gear 72 is mounted to the screw rod to be turned by a second gear 74 connected to a crank 76. The crank 76 is mounted to the cross piece for rotation by a handle 78. Thus, the arms 56 move together when the handle 78 is rotated in one direction and move apart when the handle 78 is turned in the opposite direction. Each arm 56 moves an equal distance with respect to the horizontal axis "a". The horizontal axis "a" is aligned on a vertically extending plane "p" which extends through the longitudinal center "L" of the orthotic holder 28. Thus, when the arms of the caliper 22 are tightened on the leg 12, the knee is centered between the arms and on the vertical extending plane over the center of the orthotic holder 28 and orthotic 16.

The ankle caliper 24 is formed in an identical manner with the knee caliper 22 as shown in FIG. 2 and therefore will not be discussed in detail. The ankle caliper 24 likewise is adjustable within the lower slot 49 of the standard 20 and has a pair of arms 56 that move toward a second horizontal axis. The second horizontal axis is also disposed on the vertical plane "p". Thus, when the ankle is positioned between the arms of the ankle caliper 24 and the arms are closed to engage the ankle, the ankle is centered on the vertically extending plane "p" with the knee and the center of the orthotic 16, as shown in FIG. 1.

Figure 3:
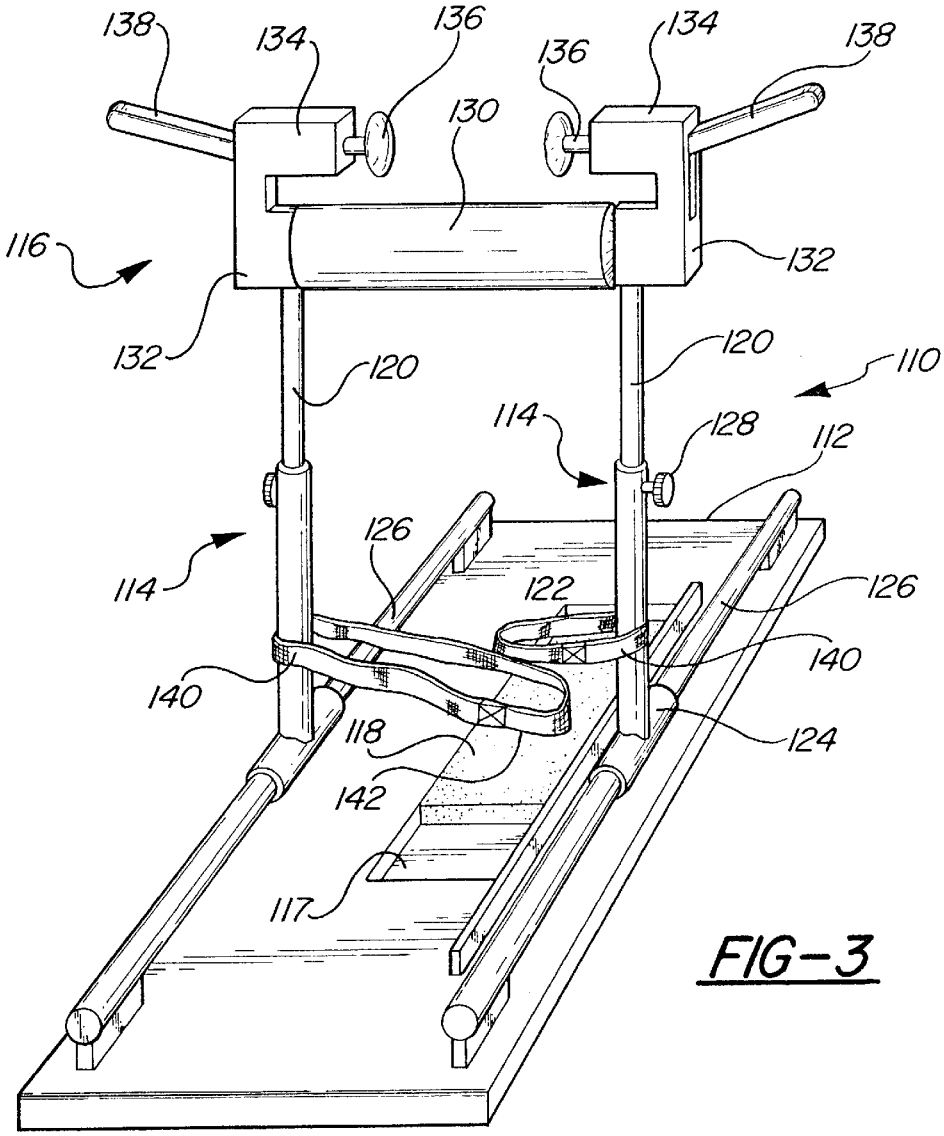
FIG. 3 is a perspective view of an alternative embodiment of the invention.

As shown in FIG. 3, an alterative embodiment of the invention is thereshown. The alternative embodiment includes an apparatus 110 having a base 112 and a pair of standards 114. The standards 114 extend upwardly to support a knee caliper 116. The base 112 has a recess 117 for holding an orthotic 118. The standards 114 have an upper portion 120 telescoping from a tubular portion 122. A sleeve 124 extends transversely at a lower end of the tubular portion 122 for receiving a rod 126 mounted to the base 112. Each standard is thus mounted for sliding movement along the rods 126. Each standard 114 has a set screw 128 mounted to the tubular portion 122 to permit telescoping adjustment of the upper portion 120 and the height of the caliper 116. The caliper 116 includes a center roller 130 and a pair of C-shaped ends 132. The roller 130 extends transversely between the standards. The ends 132 have opposed upper portion 134 having a clamp 136 movable toward and away from each other. A release lever 138 is pressable downwardly to disengage a rod portion of the clamp to permit the clamp to be moved inwardly and outwardly. A strap 140 is attached to the tubular portions 122 of each standard. Each strap 140 has an attachment device such as a buckle 142 to permit the strap to be fastened around the ankle or lower part of the leg.

Method and Use of the Apparatus

The method of use of the apparatus 10 includes first placing a moldable orthotic 16 in the holder 28 and positioning the foot 14 of a seated person on the orthotic 16. The standard is slid along over one arm 34 of the channel 26 from the rear portion 40 to position the leg between the arms 56 of the knee caliper 22 and ankle caliper 24. The lever of the lock mechanism is moved to lock the standard in position. The height of the knee caliper 22 is then adjusted by positioning a top surface 59 of the knee caliper on the inside of the knee and the handle of the crank is turned to move the arms 56 inwardly to center the knee in the neutral position with the center of the knee directly over the center of the longitudinal axis of the orthotic. The height of the ankle caliper 24 is then adjusted and the wing nuts tightened. The crank is turned to draw the arms of the ankle caliper 24 together and center the ankle on the neutralization plane. The leg is thus held in position while the resin in the orthotic undergoes its reaction. Depending on the cure time of the resin in the orthotic, the reaction of the orthotic is triggered either before or after the calipers are adjusted.

Once the resin is set, the arms of the knee and ankle calipers 22, 24 are retracted by the crank 76 and the lever 46 of the locking mechanism released, the standard is slid backwardly and moved along the connecting portion 38 of the channel and down the arm 36 to engage the opposite leg. The foot is positioned and a second orthotic 16 is placed in the second orthotic holder 30. The standard 20 is then moved forward and locked in position on the opposite leg in the same fashion as discussed above.

The alternative embodiment of the apparatus 110 is used in the same fashion as described above. The person is seated in a chair with the foot in the orthotic 118, the standards 114 are slid along the rods 126 until the roller is under the knee. The caliper is adjusted to position the roller 130 of the caliper against the knee. The knee is then centered over the orthotic and the clamps 136 are then extended. The levers 138 are released to lock the clamps 136 tightly against the knee. The straps 140 are then fastened around the ankle in such a way as to position the ankle directly below the knee in a neutral position.

Having described my invention, however, many modifications thereto may become apparent to those skilled in the art. These and other changes are within the spirit of the invention as defined by the scope of the appended claims.

I claim:

1. An apparatus for neutralizing a foot of a person for forming an orthotic comprising:

a base;

a holder for mounting said orthotic to said base;

a standard member mounted to said base;

a knee caliper mounted to said standard having a pair of arms equally spaced from a vertical plane, said arms being movably adjustable along a first horizontal axis;

means for moving each arm of said pair of arms an equal distance to and away from a vertical plane disposed between said pair of arms; and means for positioning an ankle of said person on said vertical plane, said means mounted to said standard.

2. The apparatus of claim 1 further comprising means for adjusting a height of said knee caliper with respect to said base.

3. The apparatus of claim 1, wherein said means for positioning is an ankle caliper.

4. The apparatus of claim 1, wherein said holder further comprises a pair of holders for mounting a pair of orthotics to said base.

5. The apparatus of claim 4 further having means for moving said standard from a first position adjacent one of said pair of holders to a second position adjacent another of said pair of holders.

6. The apparatus of claim 1, where said means for moving each arm of said pair of arms an equal distance to and away from a vertical plane disposed between said pair of arms, comprises a screw rod having a pair of threaded portions, each of said portions engaging one of said pair of arms.

7. The apparatus of claim 1, wherein said means for positioning comprises a pair of straps.

8. An apparatus for neutralizing a foot of a person for forming an orthotic comprising:

a base;

a pair of holders for mounting a pair of orthotics to said base;

a standard member mounted to said base;

means for moving said standard from a first position adjacent one of said pair of holders to a second position adjacent another of said pair of holders;

a knee caliper mounted to said standard having a pair of arms equally spaced from a vertical plane, said arms being movably adjustable along a first horizontal axis;

means for positioning an ankle of said person on said vertical plane, said means mounted to said standard.

9. An apparatus for neutralizing a foot of a person for forming an orthotic comprising:

a base;

a pair of holders for mounting a pair of orthotics to said base;

a standard member mounted to said base;

a knee caliper mounted to said standard having a pair of arms equally spaced from a vertical plane, said arms being movably adjustable along a first horizontal axis;

a screw rod having a pair of threaded portions, each of said portions engaging one of said pair of arms for moving each arm an equal distance to and away from a vertical plane disposed between said pair of arms; and means for positioning an ankle of said person on said vertical plane, said means mounted o said standard.

* * * * *

UNITED STATES PATENT AND TRADEMARK OFFICE

CERTIFICATE OF CORRECTION

PATENT NO. : 5,928,673

DATED : July 27, 1999

INVENTOR(S) : Daniel M. Ryan, Eric Rzeppa

It is certified that error appears in the above-indentified patent and that said Letters Patent is hereby corrected as shown below:

Column 1, line 48, delete "the" after "neutralizing";

Column 2, line 46, delete "b" insert --by--;

Column 3, line 33, delete "portion" insert --portions--;

Column 4, line 50, delete "where" insert --wherein--;

Column 4, line 53, delete "disposed" insert --displaced--

Column 6, line 10, delete "o" insert --to--.

Signed and Sealed this

Eighteenth Day of April, 2000

*Attest:*

Q. TODD DICKINSON

*Attesting Officer*

*Director of Patents and Trademarks*